US006515411B1

(12) United States Patent
Bae

(10) Patent No.: US 6,515,411 B1
(45) Date of Patent: Feb. 4, 2003

(54) CATHODE RAY TUBE HAVING REDUCED CONVERGENCE DRIFT

(75) Inventor: Min-cheol Bae, Suwon (KR)

(73) Assignee: Samsung SDI Co., Ltd., Kyungki-do (KR)

( * ) Notice: Subject to any disclaimer, the term of this patent is extended or adjusted under 35 U.S.C. 154(b) by 263 days.

(21) Appl. No.: 09/688,232

(22) Filed: Oct. 16, 2000

(30) Foreign Application Priority Data

Oct. 19, 1999 (KR) ..... 99-45311

(51) Int. Cl.[7] ..... H01J 31/00
(52) U.S. Cl. ..... 313/479; 313/477 R
(58) Field of Search ..... 313/409–417, 313/440, 441–460, 477 R, 479

(56) References Cited

U.S. PATENT DOCUMENTS 4,052,641 A * 10/1977 Dominick et al. ..... 313/450
4,101,803 A * 7/1978 Retsky et al. ..... 315/3
4,153,857 A * 5/1979 Delsing et al. ..... 313/481
4,403,170 A * 9/1983 Misono et al. ..... 313/479
4,868,454 A 9/1989 Paridaens ..... 313/412
5,536,997 A 7/1996 Van Hout ..... 313/479

FOREIGN PATENT DOCUMENTS

JP 6-260112 A 9/1994

* cited by examiner

*Primary Examiner*—Robert H. Kim
*Assistant Examiner*—Jurie Yun
(74) *Attorney, Agent, or Firm*—Leydig, Voit & Mayer, Ltd.

(57) ABSTRACT

A cathode ray tube having a reduced variation in convergence drift. An inner graphite layer coats the inner surface of a funnel, and a metal coating layer is electrically connected with the inner graphite layer on the inner surface of the neck portion. The metal coating layer does not extend to a position directly beside the focusing electrode most remote from the cathode of the electron gun of the cathode ray tube, and has a surface resistivity of $10^7\Omega/\square$ or less.

10 Claims, 3 Drawing Sheets

CATHODE RAY TUBE HAVING REDUCED CONVERGENCE DRIFT

BACKGROUND OF THE INVENTION

1. Field of the Invention

The present invention relates to a cathode ray tube (CRT), and more particularly, to a CRT having reduced convergence drift, including a metal coating layer electrically connected to a built-in graphite layer on the inner surface of a neck portion.

2. Description of the Related Art

In general, if power is applied to a CRT, an electron gun emits electron beams from a cathode. The emitted electron beams pass through electron beam apertures of a plurality of electrodes are focused and accelerated. The accelerated electron beams are selectively deflected by a deflection yoke installed in the cone portion of a bulb and excite a phosphor layer coated on the inner surface of a panel which forms a screen, thereby producing a picture.

As shown in FIG. 1, a conventional CRT 10 includes a panel having a phosphor layer on its inner surface, a funnel 12 sealed in the panel 11, and a shadow mask 13 inwardly spaced from the panel 11.

The shadow mask 13 is coupled to a shadow mask frame 14. The shadow mask frame 14 is fixedly positioned to a stud pin 15 on the inner surface of the panel 11 and a hook spring 16 connected to the stud pin 15. Accordingly, the position of the shadow mask 13 in the panel 11 is determined.

An electron gun 17 for generating electron beams producing red (R), green (G) and blue (B) light, is inserted into a neck portion 12*a* of the funnel 12. A deflection yoke 18 for deflecting the electron beams, is installed in a cone portion 12*b* of the funnel 12.

An inner graphite layer 19 and an outer graphite layer 100 coated on inner and outer surfaces of the funnel 12, respectively, and thus a high voltage applied to an anode can be stabilized by forming a condenser using the glass funnel 12 as an insulator.

As known very well, the electron gun 17 includes a triode consisting of a cathode, a control electrode and a screen electrode, a plurality of focusing electrodes opposed to the screen electrode, for forming a pre-focusing lens unit, and a final accelerating electrode opposed to the focusing electrodes, for forming a main focusing lens unit.

A shield cup 110 is installed in front of the electron gun 17. A plurality of bulb spacers 120 are fixed on the outer circumference of the shield cup 110. The bulb spacers 120 elastically contact the inner graphite layer 19 to supply a positive voltage to the final accelerating electrode.

The CRT 10 must optimize the convergence characteristic by which R, G and B electron beams emitted from the electron gun 17 converge onto a point throughout a screen, inclusive of the center and corners of the screen. In the CRT 10, when the electron beams are deflected, they may be shifted from their proper positions, a phenomenon which is called convergence drift.

The convergence drift is divided into thermal drift and charge drift. Specifically, the charge drift is caused by a change in the potential of the neck portion 12*a* due to the condition of the outer surface of the neck portion 12*a* when a high voltage is applied to the CRT 10. The initial potential of the neck portion 12*a* is attributed to accumulation of charge due to electron beam current, causing an increase in the convergence error.

To overcome the problem, U.S. Pat. No. 4,868,454 discloses a method of stabilizing the potential of the surface of the neck portion with a metallic mirror coating on the inner surface of the neck portion. However, according to this method, convergence drift is 0.2 mm or greater, that is, the effect of removing charge is weak and occurrence of arcing is highly probable.

U.S. Pat. No. 5,536,997 discloses that an enamel layer electrically contacting a conductive layer coating the inner surface of a neck portion. The formation of the enamel layer relatively reduces convergence drift. However, this method has the following problems. First, the process of manufacturing a CRT is relatively complex. In other words, a conductive layer made of graphite is applied to the inner surface of the neck portion and dried. Then, an enamel glass solution is placed in contact with the conductive layer. During this procedure, the conductive layer and the enamel layer are electrically connected. Thus, forming the enamel layer is further necessary. Second, the arcing characteristic is poor. In the course of sealing the electron gun into the neck portion, it contacts the inner surface of the neck portion. Here, since an enamel layer having a predetermined thickness is present on the inner surface of the neck portion, when the bulb spacer is mounted at a proper position it scratches the enamel layer, which provides for a path for discharge. Also, the particles of the scratched enamel layer float between the focus electrode and the final accelerating electrode, resulting in a discharge between electrodes.

SUMMARY OF THE INVENTION

To solve the above problems, it is an object of the present invention to provide a CRT which can definitely reduce convergence drift with a metal coating layer on the inner surface of a neck portion.

Accordingly, to achieve the above object, there is provided a cathode ray tube having reduced convergence drift including a panel having a phosphor layer on its inner surface, a funnel sealed in the panel and having an inner graphite layer and an outer graphite layer on inner and outer surfaces, respectively, an electron gun in a neck portion of the funnel and consisting of a cathode, a control electrode, a screen electrode, a plurality of focusing electrodes, a final accelerating electrode and a shield cup, and a metal coating layer electrically connected with the inner graphite layer on the inner surface of a neck portion and having the surface resistivity of $10^7\Omega/\square$ or less.

Here, the metal coating layer is preferably formed on the inner surface of the neck portion higher than the top surface of the focusing electrodes.

Also, the metal coating layer is preferably electrically connected with the final accelerating electrode via the shield cup.

Also, the metal coating layer may be selectively formed on the inner surface of the neck portion adjacent to side electron beam apertures for red and blue electron beams.

Further, the metal coating layer is preferably a metal thin film having either iron or chrome as a main component. Also, the metal coating layer may be a metal thin film having both iron and chrome as main components.

BRIEF DESCRIPTION OF THE DRAWINGS

The above object and advantages of the present invention will become more apparent by describing in detail a preferred embodiment thereof with reference to the attached drawings in which.

DESCRIPTION OF THE PREFERRED EMBODIMENT

Figure 1:
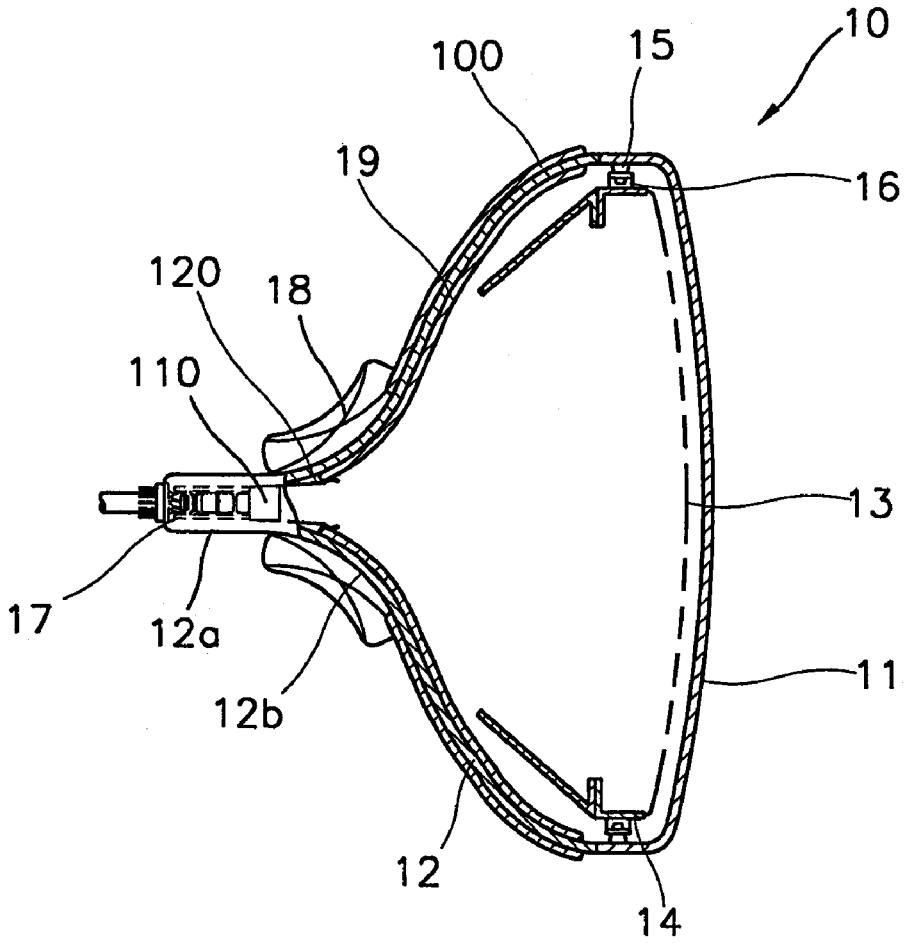
FIG. 1 (PRIOR ART)
FIG. 1 is a cross section of a conventional CRT.
Figure 2:
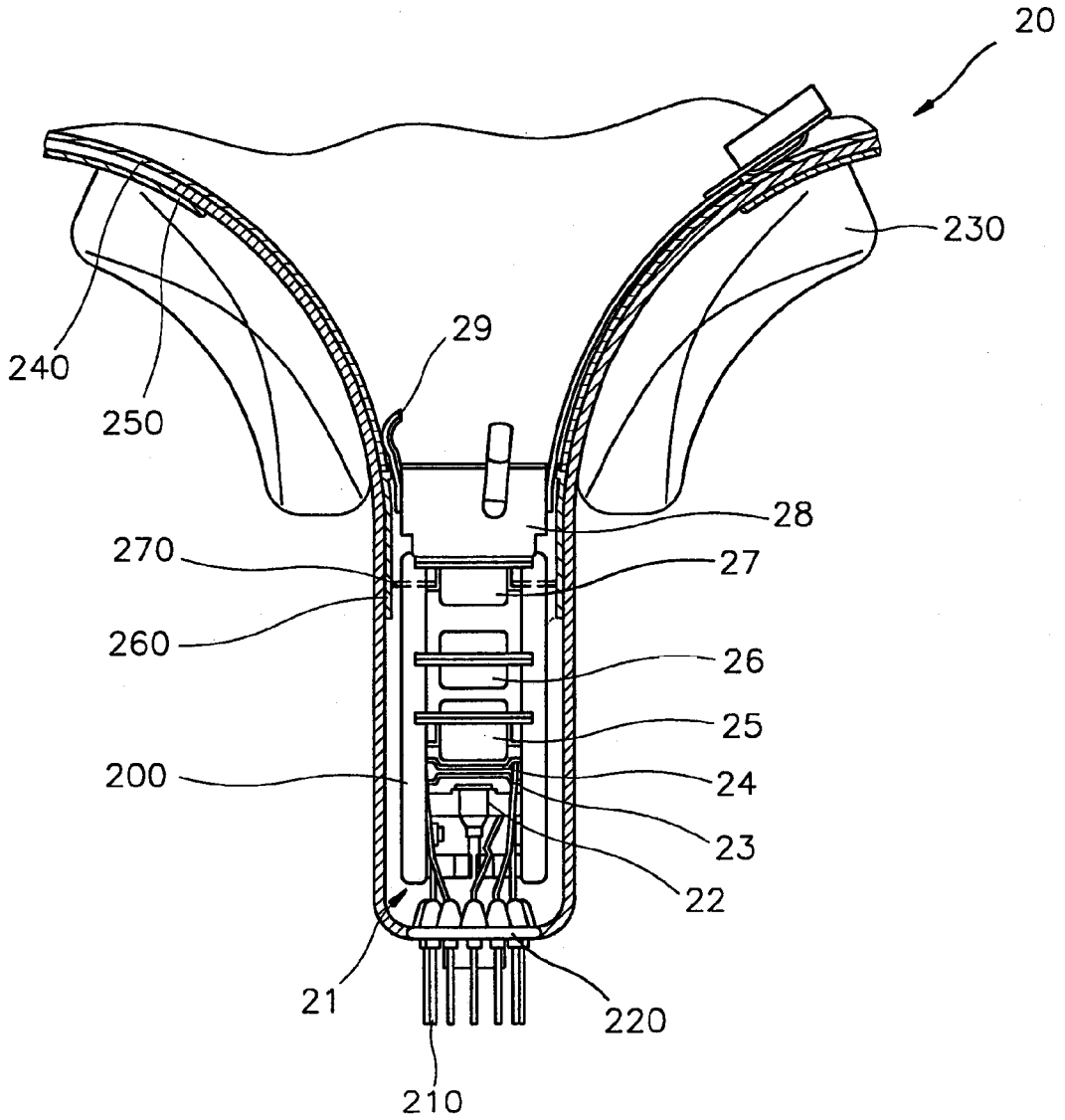
FIG. 2 is a cross-sectional view illustrating a neck portion of a CRT according to the present invention.

In FIG. 2 showing the structure of a neck portion 20 of a CRT according to the present invention, an electron gun 21 is installed inside the neck portion 20.

The electron gun 21 includes a triode consisting of a cathode 22, a control electrode 23 and a screen electrode 24. A plurality of first and second focusing electrodes 25 and 26 opposed to the screen electrode 24 for forming a pre-focusing lens unit, are disposed in front of the screen electrode 24. A final accelerating electrode 27 opposed to the second focusing electrode 26 for forming a main focusing lens unit, is disposed in front of the second focusing electrode 26. A shield cup 28 is installed in front of the final accelerating electrode 27. A plurality of bulb spacers 29 are fixed on the outer circumference of the shield cup 28.

The respective electrodes are supported by a bead glass 200 parallel to both internal sides of the neck portion 20. Leads 210 for applying voltages to the respective electrodes are installed in the lower portion of the cathode 22. The leads 210 are drawn outside the neck portion 20 and supported by a stem 220. The stem 220 is sealed when the electron gun 21 is in the neck portion 20.

A deflection yoke 230 is installed in the cone portion of the neck portion 20 so that electron beams from the electron gun 21 are deflected to the phosphor layer on the inner surface of a panel.

An electrically conductive inner graphite layer 240 coats on the inner surface of the neck portion 20. The inner graphite layer 240 reaches a position adjacent to the shield cup 28. An outer graphite layer 250 coats the outer surface of the neck portion 20. The inner and outer graphite layers 240 and 250 form a condenser using the funnel made of glass as an insulator, thereby stabilizing the high voltage applied to the anode.

The bulb spacers 29 elastically contact the inner graphite layer 240. The bulb spacers 29 receives the high voltage applied to the anode and transmit the received high voltage to the final accelerating electrode 27 through the shield cup 28. The shield cup 28 serves to correct minute convergence of the corner of a screen by adjusting the movement of an electron beam when the electron beam emitted from the cathode 22 passes through the electron beam apertures of the respective electrodes and lands on the phosphor layer of the panel.

Here, a metal coating layer 260 coats the inner surface of the neck portion 20 for purpose of preventing the convergence drift of R and B electron beams to the corner of the screen due to accumulation of positive charge at a main focusing lens unit between the second focusing electrode 26 and the final accelerating electrode 27.

The metal coating layer 260 overlaps with and is electrically connected to the inner graphite layer 240, and extends lengthwise by a predetermined length with respect to the neck portion 20. The predetermined length preferably does not extend to be directly beside of the second focusing electrode 26 in order to reduce a discharge possibility.

Also, the metal coating layer 260 may be present only on the inner surface of the neck portion 20 adjacent to side apertures for R and B electron beams, among R, G and B electron beam apertures formed in-line on the same plane as that of the final accelerating electrode 27.

The metal coating layer 260 is made of metal such as nickel or chrome a thickness of several micrometers or less. Here, the metal coating layer 260 preferably has surface resistivity of $10^7\Omega/\square$ or less for the purpose of attaining stable charge drift.

Although the metal coating layer 260 may be formed by inserting a separate metal material into the neck portion 20, the electron gun 21 is preferably used for facilitating assembling work. In other words, the metal coating layer 260 may be formed by evaporating some of components contained in the material of the electron gun 21 on the inner surface of the neck portion 20 through local inductive heating.

Alternatively, the metal coating layer 260 may be electrically connected with the final accelerating electrode 27 via the shield cup 28, or may be electrically connected with the final accelerating electrode 27 using a connection means, e.g., a conductive wire 270.

The process of forming the metal coating layer 260 will now be described in more detail.

In evacuating a CRT, a bombardment step is necessarily further provided for removing foreign matter adsorbed into the electrodes and for preventing adsorption of the gas produced during decomposition of the cathode 22 from being adsorbed into the electrodes. In other words, an induction coil is placed outside the neck portion 20 at a position corresponding to the electron gun 21. Then, if high-frequency inductive heating is applied, the surfaces of the electrodes of the electron gun 21 are heated to 700 to 1000° C. for several seconds. Accordingly, the foreign matter is burnt and the gas adsorbed into the electrodes is evacuated.

The metal coating layer 260, can be formed during the bombardment step. In other words, the induction coil is placed outside the neck portion 20 corresponding to the final accelerating electrode 27 and the shield cup 28.

Subsequently, if local inductive heating is applied, metal components contained in the electron gun 21 coat the inner surface of the neck portion 20 due to high-frequency inductive heating. Here, in the electron gun 21 made of stainless steel containing 14 wt % of chrome and 16 wt % of nickel, the chrome and nickel coat the inner surface of the neck portion 20 in the form of a thin film having a thickness of several micrometers. A metal coating layer made of either nickel or chrome, or a multiple metal coating layer made of nickel and chrome may be formed on the inner surface of the neck portion 20 according to the heating temperature. Also, an iron alloy containing 42 wt % of nickel can be used as the material for electrodes. In this case, the nickel is inductively heated to a temperature in the range in which it can coat the inner surface of the neck portion 20. Otherwise, the metal coating layer 260 may be formed by installing a separate metal element within the neck portion 20.

Also, the metal coating layer 260 must be restricted in position on the inner surface of the neck portion 20. In other words, the metal coating layer 260 must not be directly beside the second focusing electrode 26, which is the final focusing electrode, in order to reinforce non-arcing characteristics.

In order to prevent discharging, a sufficient distance between the metal coating layer 260 and the main focusing lens unit must be provided. To this end, the distance between the inner surface of the neck portion 20 and the outer surface of the second focusing electrode 26 is preferably larger than the distance between the second focusing electrode 26 and the final accelerating electrode 27, constituting the main focusing lens unit. This is for solving the problem caused by arcing by forming a discharge space first between the second focusing electrode 26 and the final accelerating electrode 27, even if the resistance of the metal coating layer 260 is low.

In the aforementioned CRT according to the present invention, the R and B electron beams drift to the corner due to accumulation of positive charges in the neck portion 20, caused by electron beam current during an initial stage of applying a high voltage, resulting in a change in the convergence for several hours.

Here, the metal coating layer 260 is electrically connected with the inner graphite layer 240 to which a positive electrode voltage is applied, thereby reducing accumulation of positive charges to reduce a convergence drift.

Figure 3:
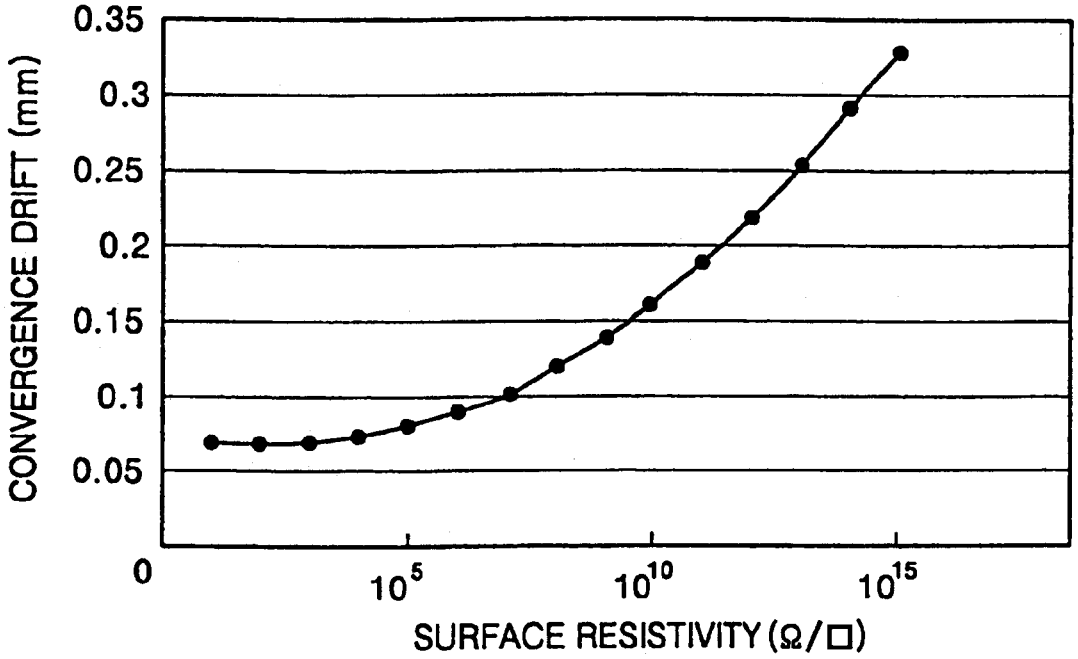
FIG. 3 is a graph illustrating the convergence drift according to variation in the resistivity of the inner surface of the neck portion of a CRT according to the present invention.

FIG. 3 and Table 1 show convergence drifts depending on a variation in the resistivity of the inner surface of the neck portion 20 according to the present invention.

According to the experiment carried out by the inventor, the metal coating layer 260 formed on the inner surface of the neck portion 20 not extending to a location directly beside the second focusing electrode 26, by a high-frequency inductive heating method using the electron gun 21 as a target. Also, the convergence drift of the metal coating layer 260 was measured by evaporating the metal coating layer 260 so as to have different levels of resistance. The distance between R and B electron beams was measured for 24 hours after 30 minutes from the time when the power is applied, i.e., after the thermal convergence drift is stabilized.

TABLE 1

| Resistivity α/□ (mm) | Convergence drift |
|---|---|
| $10^0$ | 0.07 |
| $10^1$ | 0.07 |
| $10^2$ | 0.07 |
| $10^3$ | 0.071 |
| $10^4$ | 0.074 |
| $10^5$ | 0.08 |
| $10^6$ | 0.09 |
| $10^7$ | 0.10 |
| $10^8$ | 0.118 |
| $10^9$ | 0.138 |
| $10^{10}$ | 0.16 |
| $10^{11}$ | 0.185 |
| $10^{12}$ | 0.215 |
| $10^{13}$ | 0.25 |
| $10^{14}$ | 0.285 |
| $10^{15}$ | 0.32 |

In the graph shown in FIG. 3, the x-axis indicates the surface resistivity of the inner surface of the neck portion 20, and the y-axis indicates the convergence drift.

Referring to FIG. 3 and Table 1, when the metal coating layer 260 is not formed, the surface resistivity of the inner surface of the neck portion 20 is approximately $10^{13}$ to $10^{17}\Omega/\square$. If the metal coating layer 260 has a surface resistivity of approximately $10^{12}\Omega/\square$, the convergence drift exceeds 0.2 mm. In general, a high-resolution CRT requires the convergence drift of 0.1 mm or less.

When the metal coating layer 260 has the surface resistivity of $10^7\Omega/\square$, the cvonvergence drift is 0.1 mm, that is, the potential stability increases. In other words, as the metal coating layer 260 has the surface resistivity of $10^7\Omega/\square$ or less, the convergence drift correcting effect is stabilized. Thus, in order to achieve stability of a charge drift, the surface resistivity of the metal coating layer 260 is preferably maintained at the level of $10^7\Omega/\square$ or less. On the other hand, when the metal coating layer 260 has a surface resistivity of $10^8\Omega/\square$ or greater, the potential stability decreases. Also, when the metal coating layer 260 has a surface resistivity of $10^{12}\Omega/\square$ or greater, the charge drift correcting effect is noticeably lowered.

As described above, in the CRT having a reduced convergence drift according to the present invention, the variation in the convergence drift can be minimized by maintaining a stable neck potential, with a metal coating layer on the inner surface of a neck portion, electrically connected to an inner graphite layer, and electrically connecting the metal coating layer to the final accelerating electrode.

Although the present invention has been described with reference to illustrative embodiment, the invention is not limited thereto and various changes and modifications may be effected by one skilled in the art. It is therefore contemplated that the true spirit and scope of the present invention be set forth in the appended claims.

What is claimed is:

1. A cathode ray tube having reduced convergence drift comprising:

a panel having a phosphor layer on an inner surface of the panel;

a funnel sealed to the panel and having an inner graphite layer and an outer graphite layer on inner and outer surfaces, respectively of the funnel;

an electron gun in a neck portion of the funnel and including of a cathode, a control electrode, a screen electrode, a plurality of focusing electrodes, a final accelerating electrode, and a shield cup; and a metal coating layer electrically connected with the inner graphite layer on an inner surface of the neck portion and having a surface resistivity of no more than $10^7\Omega\square$.

2. The cathode ray tube according to claim 1, wherein the metal coating layer on the inner surface of the neck portion does not extend to a position directly beside a surface of the focusing electrodes.

3. The cathode ray tube according to claim 1, wherein the metal coating layer is only present on the inner surface of the neck portion adjacent to side electron beam apertures for electron beams producing red and blue light on the panel.

4. The cathode ray tube according to claim 1, wherein the metal coating layer has nickel as a main component.

5. The cathode ray tube according to claim 1, wherein the metal coating layer has chrome as a main component.

6. The cathode ray tube according to claim 1, wherein the metal coating layer has nickel and chrome as main components.

7. The cathode ray tube according to claim 1, wherein the metal coating layer is formed on the inner surface of the neck portion using the electron gun as a target.

8. The cathode ray tube according to claim 7, wherein the metal coating layer is formed by high-frequency inductive heating.

9. The cathode ray tube according to claim 1, wherein the metal coating layer is electrically connected to the final accelerating electrode via the shield cup.

10. The cathode ray tube according to claim 1, wherein the metal coating layer is electrically connected to the final accelerating electrode via a conductive wire.

* * * * *